United States Patent [19]

Albero

[11] 4,233,027

[45] Nov. 11, 1980

[54] METHOD FOR PRINTING AND FLOCKING FABRICS SIMULTANEOUSLY

[76] Inventor: Rafael P. Albero, Plaza del Pintor Gisbert, num. 2, Alcoy (Alicante), Spain

[21] Appl. No.: 901,500

[22] Filed: May 1, 1978

[30] Foreign Application Priority Data

Jan. 28, 1978 [ES] Spain ..... 466.438

[51] Int. Cl.[3] ..... D06P 5/00; D06P 7/00

[52] U.S. Cl. ..... 8/488; 8/115

[58] Field of Search ..... 8/17, 62, 115

[56] References Cited

U.S. PATENT DOCUMENTS

| | | | |
|---|---|---|---|
| 2,981,588 | 4/1961 | Haber | 8/62 |
| 3,849,158 | 11/1974 | Palmer et al. | 8/17 |
| 3,945,791 | 3/1976 | Bohrn | 8/17 |
| 4,125,657 | 11/1978 | Gonzalez | 428/90 |

FOREIGN PATENT DOCUMENTS 53-36058 9/1978 Japan .

OTHER PUBLICATIONS

Webster's New World Dictionary, Second College Edition (World Publishing Co.), 1972, p. 1328.

*Primary Examiner*—A. Lionel Clingman
*Attorney, Agent, or Firm*—Bucknam and Archer

[57] ABSTRACT

A method for printing and flocking a fabric in which the fabric is moved along a path, dye is applied to the fabric in accordance with a printing pattern to print such pattern directly on the fabric itself without interrupting the moving thereof, adhesive is applied over regions of the fabric to be flocked, again without interrupting the moving of the fabric, and flocking material is applied to the adhesive regions of the fabric, also without interrupting the moving thereof.

3 Claims, No Drawings

METHOD FOR PRINTING AND FLOCKING FABRICS SIMULTANEOUSLY

The object of the present Patent of Invention application refers to a "METHOD FOR PRINTING AND FLOCKING FABRICS SIMULTANEOUSLY", which provides essential characteristics of novelty, constituting considerable advantages over that known until now to achieve the aim quoted.

In the textile sector of industry, concerning fabrics to be printed and flocked, the classic method traditionally followed is well known, consisting of executing separately two phases or clearly differentiated tasks: one in which the printing of the colours is performed projected for the design chosen, and another subsequent and independent in which the flocking operation takes place, functions which obviously imply a serious disadvantage, due to the fact that the textile product to be treated has to undergo double handling, although it is feasible to simplify the said printing and flocking work, performing the two said functions simultaneously with a single passing of the fabric.

It is likewise known, even by the consumer public itself, that on many occasions the printed fabrics offered on the market suffer from printing and flocking defects as the colours and capilliaries applied do not coincide perfectly accurately with the previously designed drawing, deficiencies commonly known as manufacturing defects, of vital importance since, when they are noticed, the product runs the risk of being rejected by the public and consequently depreciated, with the possible loss of credit of the manufacturer and its repercussion in the seller, as in these circumstances the buyer usually proves demanding and on the defensive of his own interests.

To avoid this series of disadvantages and possible damages, the method has been designed, disclosed in the present specifications, tending to achieve absolute perfection in the printing and flocking of fabrics, tasks which prove extremely problematic with the normal use of prior art through the two stages commented on.

In order to satisfactorily reach the aim proposed, and to be able to offer the realization of printing and flocking with due guarantees, it has been foreseen that the pieces of cloth intended to be printed and flocked be treated simultaneously in a single pass and with no interruption whatever, through the joint use of the adequate devices, in a synchronized linear function, fact which offers the security of a performance without failures or imperfections, so common in prior practice, as already mentioned.

Hence, the fabric to be printed and flocked with the new method, performs its normal course receiving each of the colours foreseen and the adhesive simultaneously and perfectly synchronized, using a circular silk-screen printing system to replace the classical flat one, which would correspond to a lyonese printing, previously engraving the drawing in the printing and impregnation devices, inside which the respective products are placed, which are driven towards the outlet surface by adequate resilient means, pressing on the inner face of the said surface, making dyes and adhesive flow through the engraving points which define the drawing and mark it on the fabric.

Once the print has been applied and the fabric provided with the respective adhesive, it passes without a pause in the linear movement to the flocking process, which is applied with absolute precision in the spaces foreseen, since the three functions mentioned: printing, impregnation of the adhesive and the following flocking operation are strictly calculated and synchronized with the movement given to the part treated.

On completion of these operations, the printed and flocked textile product passes on to the normal drying and subsequent winding process, following conventional practice, thus being ready for packing, shipping and offering to the market.

After disclosing the present invention, what is declared as new and our own invention includes the following claims:

1. A method for printing and flocking a fabric which comprises the steps of moving the fabric along a path; applying dye to the fabric in accordance with a printing pattern to print such pattern directly on the fabric itself without interrupting the moving thereof; applying adhesive over regions of the fabric to be flocked without interrupting the moving of the fabric; and, applying flocking material to said regions of the fabric without interrupting the moving thereof.

2. A method according to claim 1 wherein said dye applying step is performed by a circular silk-printing system.

3. A method according to claim 1 wherein the fabric movement is linear, and the steps of applying dye, adhesive and flocking material are performed in synchronous relation.

* * * * *